US008783552B2

(12) United States Patent
Xu et al.

(10) Patent No.: US 8,783,552 B2
(45) Date of Patent: Jul. 22, 2014

(54) CASHBOX AND MONEY VALIDATOR WITH THE SAME

(75) Inventors: Fang Xu, Shandong (CN); Jigang Zhang, Shandong (CN); Kelin Guo, Shandong (CN); Zhenhua Song, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 0 days.

(21) Appl. No.: 14/002,325

(22) PCT Filed: Feb. 17, 2012

(86) PCT No.: PCT/CN2012/071286
§ 371 (c)(1),
(2), (4) Date: Aug. 29, 2013

(87) PCT Pub. No.: WO2012/116601
PCT Pub. Date: Sep. 7, 2012

(65) Prior Publication Data

US 2014/0131374 A1 May 15, 2014

(30) Foreign Application Priority Data

Mar. 1, 2011 (CN) ..... 2011 1 0049204

(51) Int. Cl.
*A45C 1/12* (2006.01)
*G07D 11/00* (2006.01)

(52) U.S. Cl.
CPC ..... *G07D 11/009* (2013.01); *G07D 11/006* (2013.01)
USPC ..... 232/1 D; 232/15; 194/350; 109/52; 235/379

(58) Field of Classification Search
USPC ..... 232/1 D, 15, 16, 43.2; 194/350; 109/45, 109/47, 52; 902/9; 235/379
See application file for complete search history.

(56) References Cited

U.S. PATENT DOCUMENTS 3,292,849 A * 12/1966 Ewing ..... 232/43.2
4,186,977 A * 2/1980 Gilovich et al. ..... 312/215

(Continued)

FOREIGN PATENT DOCUMENTS

CN 1987936 A 6/2007
CN 101751715 A 6/2010

(Continued)

OTHER PUBLICATIONS

International Search Report and Written Opinion for International Application No. PCT/CN2012/071286 mailed May 31, 2012.

(Continued)

*Primary Examiner* — William Miller
(74) *Attorney, Agent, or Firm* — Brian J. Colandreo; Michael T. Abramson; Holland & Knight LLP

(57) ABSTRACT

A cashbox comprises: a left shell, comprising first, second and third side walls; a right shell, being symmetric with the left shell, and comprising fourth, fifth and sixth side walls; a first fixing panel, fixedly connected to the second side wall and the fifth side wall through screws; a second fixing panel, fixedly connected to the third side wall and the sixth side wall through screws; an upper cover, which comprises a money entrance and is inserted with the left shell and the right shell, so as to form the top surface of the cashbox; a box door fixing panel and a box door pivotally connected to the box door fixing panel through a pivot shaft, forming the back surface of the cashbox together, and all the screws are provided in the cashbox.

14 Claims, 10 Drawing Sheets

(56) References Cited

U.S. PATENT DOCUMENTS

| | | | | | |
|---|---|---|---|---|---|
| 4,434,931 | A | * | 3/1984 | Hunt et al. | 232/15 |
| 4,638,746 | A | * | 1/1987 | Ishigure | 109/52 |
| 4,714,029 | A | * | 12/1987 | Idegren et al. | 109/45 |
| 5,129,330 | A | * | 7/1992 | McKay et al. | 109/59 R |
| 5,161,736 | A | * | 11/1992 | Roccoberton et al. | 232/15 |
| 5,533,605 | A | * | 7/1996 | Mays et al. | 194/206 |
| 5,607,102 | A | * | 3/1997 | Walsh et al. | 232/1 D |
| 5,890,439 | A | | 4/1999 | McGunn | |
| 6,059,090 | A | * | 5/2000 | Davis et al. | 194/350 |
| 6,712,352 | B2 | * | 3/2004 | Bergeron et al. | 271/180 |
| 7,837,095 | B2 | * | 11/2010 | Clauser et al. | 235/379 |
| 2003/0116623 | A1 | | 6/2003 | Park | |

FOREIGN PATENT DOCUMENTS

| | | | |
|---|---|---|---|
| DE | 19948719 | A1 | 4/2001 |
| JP | 6264667 | A | 9/1994 |

OTHER PUBLICATIONS

International Preliminary Report on Patentability for International Application No. PCT/CN2012/071286 dated Sep. 3, 2013.
English abstract for CN1987936. 1 page.
English abstract for CN101751715. 1 page.
English abstract for JP6264667. 1 page.
English abstract for DE19948719. 1 page.

* cited by examiner

CASHBOX AND MONEY VALIDATOR WITH THE SAME

RELATED APPLICATIONS

The subject application is a U.S. National Stage application of International Application No. PCT/CN2012/071286, filed on 17 Feb. 2012, which claims the priority of Chinese Patent Application No.: 201110049204.0, filed on 1 Mar. 2011, the contents of which are herein incorporated by reference in its entirety.

This application claims the priority of the Chinese invention patent application which was filed with the State Intellectual Property Office of the PRC in Mar. 1, 2011, and of which the application number is 201110049204.0, and the title of the invention is "cashbox and money validator with the same"; all the contents of the patent application are incorporated herewith by reference.

TECHNICAL FIELD OF THE INVENTION

The invention relates to a cashbox and a money validator with the cashbox.

BACKGROUND OF THE INVENTION

With social development and technological progress, there are a lot of self-service vending devices which adopt self-checkout modes, thus greatly saving the manpower, and improving the convenience of consumption for people. Generally, the money validator for checking the true and counterfeit money is installed on the self-service vending device, wherein, the money validator includes a cashbox for storing the valid money which has been identified, when the cashbox is filled, or after completing a settlement cycle, the cashbox needs to be disassembled and transported to the settlement center; and then the cashbox is opened by specially-assigned persons to take out the money. In actual use, the persons with different permissions take responsible for the operations of maintaining and transporting the cashbox, and taking out money, therefore, the cashbox needs to be designed safely and reliably, so as to prevent the maintainers and transporters from contacting the money inside the cashbox during the process of maintaining and transporting the cashbox, thus guaranteeing the security of the money inside the cashbox.

The common cashbox is combined by welding; and the problem of the cashbox which adopts such mode is that the components of the cashbox cannot be repaired once destroyed, namely, the cashbox only can be used once, and needs higher maintenance cost. For this reason, a plurality of components of some cashboxes are combined by screws via the external fixing mode, the components can be conveniently disassembled and replaced once destroyed. However, although the maintenance cost is reduced by adopting such mode, as the screws are exposed, the cashbox can be easily disassembled from outside, such mode cannot satisfy the security requirements.

SUMMARY OF THE INVENTION

The purpose of the invention is to provide a cashbox which has no screw exposed externally, and has a safe and reliable structure, and has high maintainability. Meanwhile, the invention also provides a money validator with the cashbox.

For this purpose, according to one aspect, the invention provides a cashbox, comprising a front surface, a back surface, a left surface, a right surface, a bottom surface, and a top surface, wherein the cashbox comprises: a left shell, comprising: a first side wall forming the left surface, a second side wall partially extending across the front surface, and a third side wall partially extending across the bottom surface; a right shell, comprising: a fourth side wall forming the right surface, a fifth side wall partially extending across the front surface, and a sixth side wall partially extending across the bottom surface; a first fixing panel, fixedly connected to the second side wall and the fifth side wall which are located at the inner side of the first fixing panel through screws, so as to form the front surface together with the second side wall and the fifth side wall; a second fixing panel, fixedly connected to the third side wall and the sixth side wall which are located at the inner side of the second fixing panel through screws, so as to form the bottom surface together with the third side wall and the sixth side wall; an upper cover with a money entrance, forming the top surface, and being inserted with the left shell and the right shell; and a box door fixing panel and a box door which is pivotally connected to the box door fixing panel through a pivot shaft, the box door fixing panel and the box door forming the back surface of the cashbox together, wherein, the box door fixing panel is inserted with the left shell and the right shell, and the box door is connected with the upper cover through a security lock, wherein, all the screws are installed in the cashbox.

Further, the edge of the third side wall and the edge of the sixth side wall are connected together to extend across the whole bottom surface.

Further, the edge of the second side wall and the edge of the fifth side wall are connected together to extend across the whole front surface.

Further, the upper cover is further fixedly connected with the left shell and the right shell through screws, and the fixing holes for the screws are located on the side walls of the upper cover, which are respectively in overlapping extension with the left shell and the right shell, and are located in the position far away from the front surface.

Further, the box door fixing panel is further fixedly connected with the left shell and the right shell through screws, and the fixing holes for the screws are located on the bottom wall of the box door fixing panel, which is in overlapping extension with the left shell and the right shell.

Further, the cashbox further comprises: a money pressing assembly located on the lower surface of the upper cover; and a paper money supporting plate assembly located in the cashbox, wherein, the paper money supporting plate assembly comprises: a supporting plate adapted to the money pressing assembly and an elastic element which elastically supports the supporting plate.

Further, a guiding element is provided on the supporting plate, and a guide rail adapted to the guiding element is provided on the left shell and the right shell.

Further, the guiding element is a gear, and the guide rail is a rack adapted to the gear.

Further, the elastic element comprises a second elastic element and a third elastic element; the paper money supporting plate assembly further comprises a bracket plate which supports the second elastic element and the third elastic element and a first elastic element which supports the bracket plate.

According to another aspect, the invention provides a money validator, comprising a cashbox according to any one of claims 1 to 9, a money identification mechanism, and a bracket which supports the cashbox and the money identification mechanism, wherein, the money entrance of the cashbox is communicated with the money exit of the money identification mechanism.

The invention also provides a cashbox, comprising a front surface, a back surface, a left surface, a right surface, a bottom surface and a top surface, wherein, the cashbox comprises: a left shell, comprising: a first side wall forming the left surface, a second side wall partially extending across the front surface, and a third side wall partially extending across the bottom surface; a right shell, comprising: a fourth side wall forming the right surface, a fifth side wall partially extending across the front surface, and a sixth side wall partially extending across the bottom surface; a first fixing panel, fixedly connected to the second side wall and the fifth side wall through screws to form the front surface together with the second side wall and the fifth side wall; a second fixing panel, fixedly connected to the third side wall and the sixth side wall through screws to form the bottom surface together with the third side wall and the sixth side wall; an upper cover with a money entrance, forming the top surface, and inserted with the left shell and the right shell; and a box door fixing panel and a box door which is pivotally connected to the box door fixing panel through a pivot shaft, forming the back surface of the cashbox together, wherein, the box door fixing panel is inserted with the left shell and the right shell, and the box door is connected with the upper cover through a security lock, wherein, all the screws are installed in the cashbox.

Further, the edge of the third side wall and the edge of the sixth side wall are connected together to extend across the whole bottom surface.

Further, the edge of the second side wall and the edge of the fifth side wall are connected together to extend across the whole front surface.

Further, the cashbox further comprises: a money pressing assembly located on the lower surface of the upper cover; and a paper money supporting plate assembly located in the cashbox, wherein, the paper money supporting plate assembly comprises: a supporting plate adapted to the money pressing assembly and an elastic element which elastically supports the supporting plate.

The cashbox provided by the invention adopts the screws to fixedly connect each component from the inside of the box body, such that no exposed screw is installed outside the cashbox, and the cashbox only can be opened by using a key to open the security lock; the cashbox provided by the invention has a firm, safe and reliable structure, and is convenient to be disassembled and replaced once destroyed.

Except the purposes, characteristics and advantages described above, other purposes, characteristics and advantages owned by the invention will be combined with the drawings to further describe the invention in details.

BRIEF DESCRIPTION OF THE DRAWINGS

The drawings for forming a part of the specification and further understanding the invention show the preferred embodiments of the invention, and are used for explaining the principle of the invention with the specification. Wherein.

DETAILED DESCRIPTION OF THE INVENTION

The embodiments of the invention are described below in details with reference to the drawings, however, the invention can be implemented via different modes which are limited and covered by the claims.

The cashbox provided by the invention can be used for storing the money such as coins or paper money.

Figure 1:
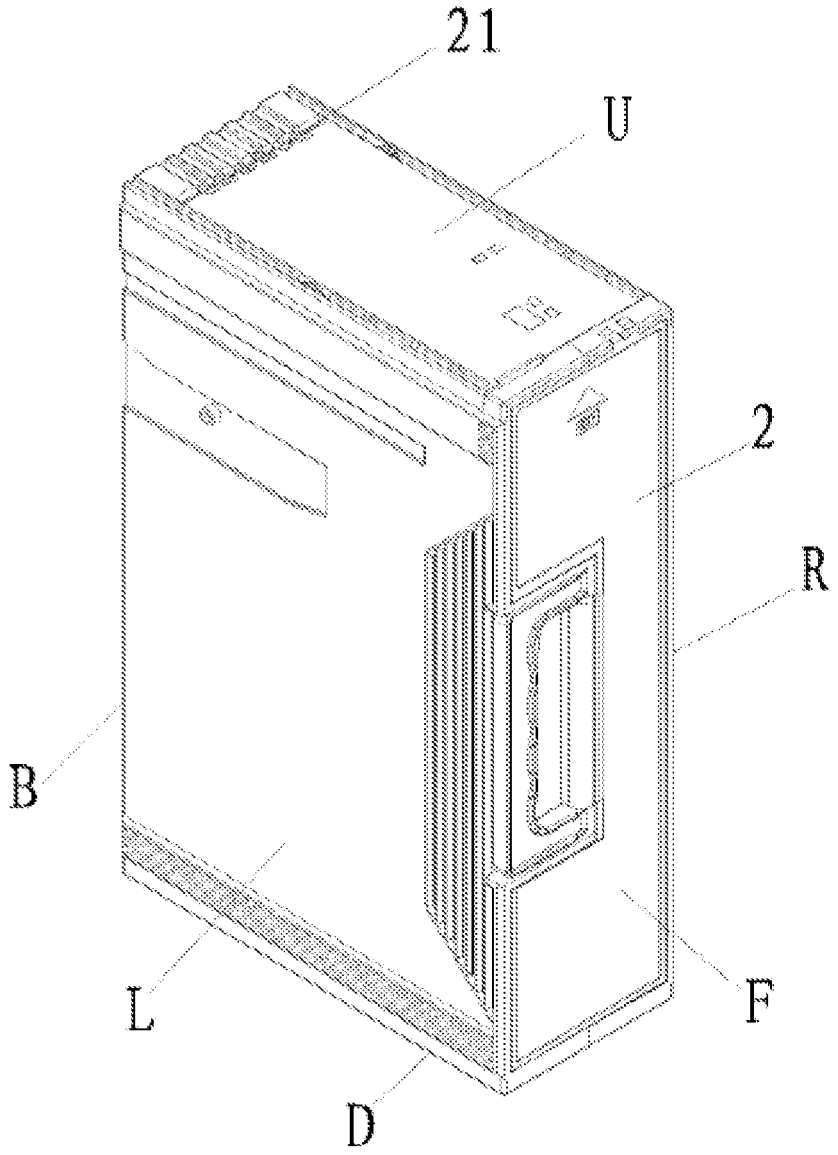
FIG. 1 shows the first axonometric drawing of the first embodiment according to the cashbox provided by the invention.
Figure 2:
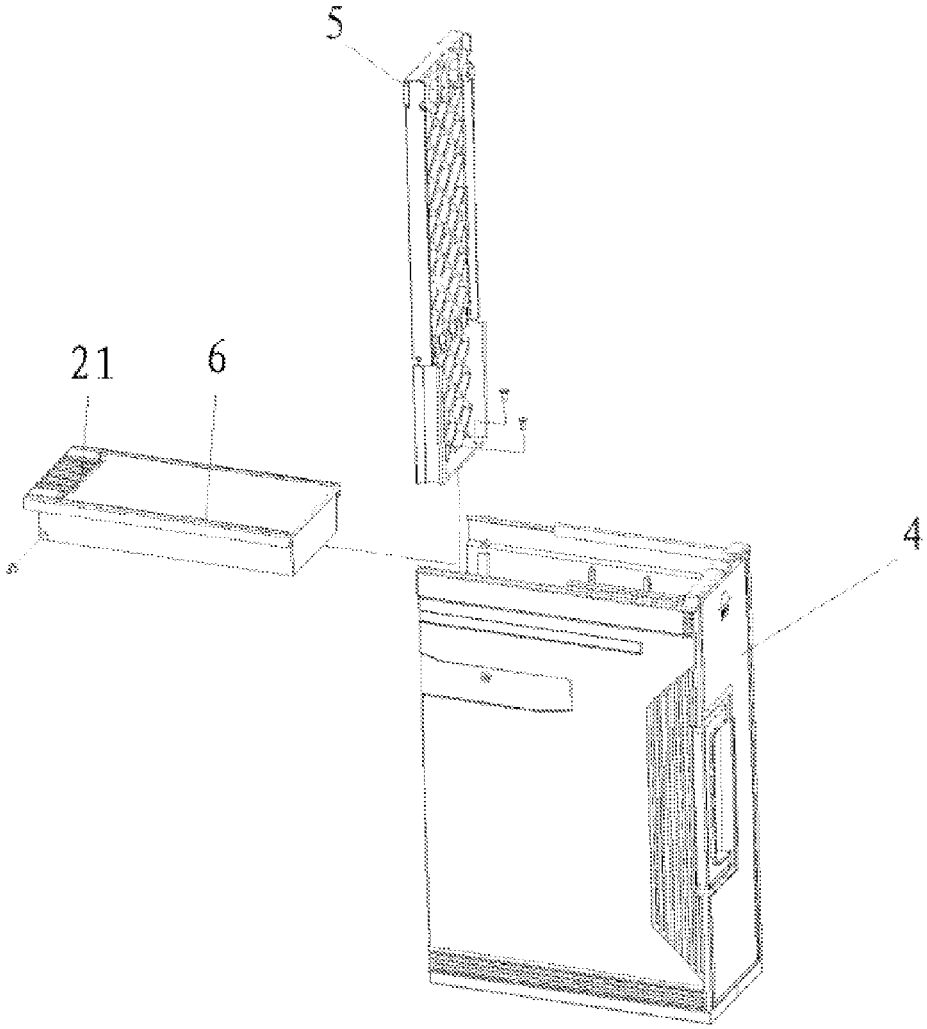
FIG. 2 shows a structural decomposition diagram of the cashbox shown in FIG. 1.
Figure 3:
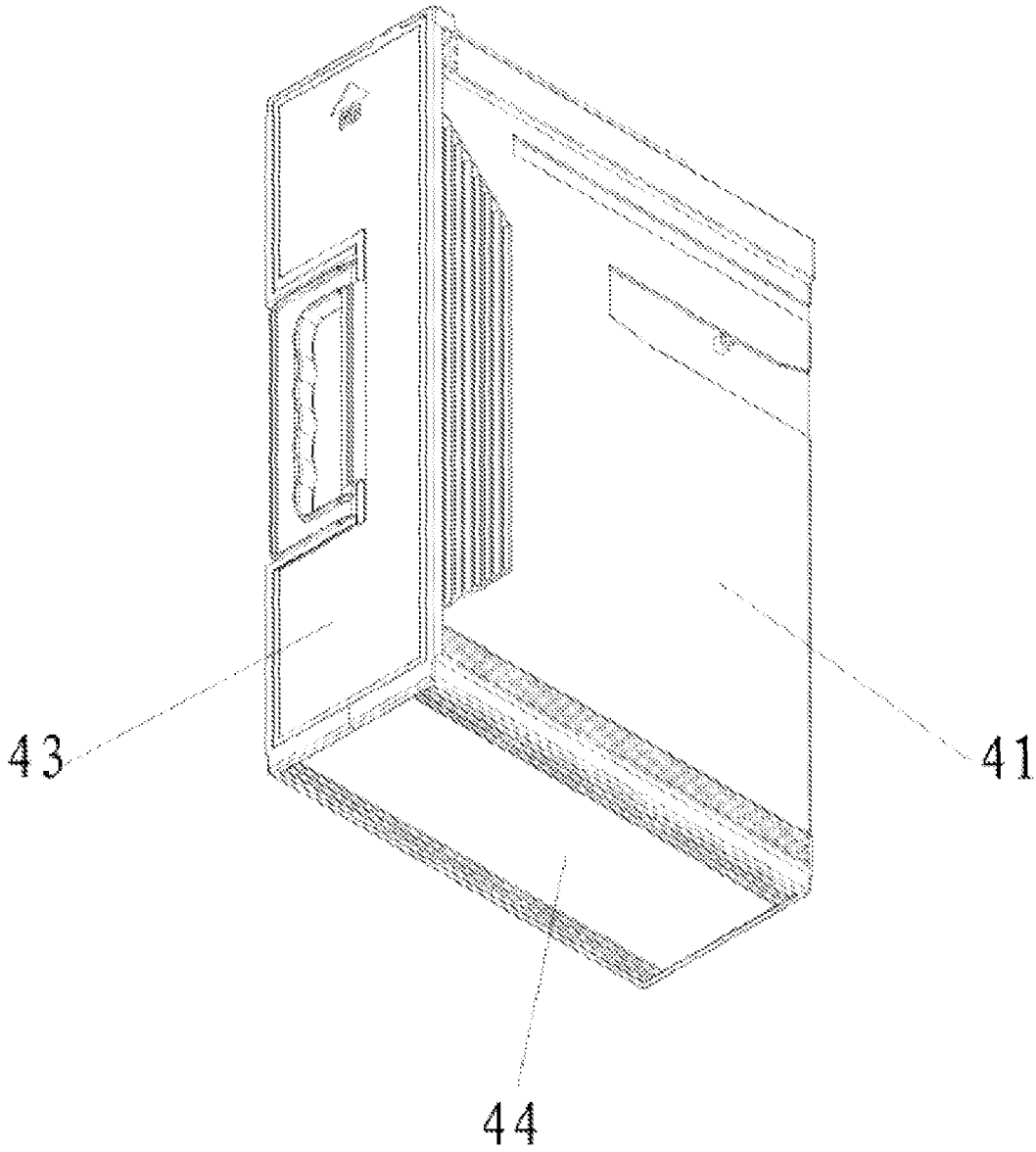
FIG. 3 shows the second axonometric drawing of the cashbox shown in FIG. 1.

FIG. 1 shows the first axonometric drawing of the first embodiment according to the cashbox provided by the invention; FIG. 2 shows a structural decomposition diagram of the cashbox shown in FIG. 1; FIG. 3 shows the second axonometric drawing of the cashbox shown in FIG. 1.

The cashbox 2 is generally a cuboid structure, for the convenience of description, as shown in FIG. 1, the six surfaces of the cashbox are respectively named as a front surface F, a back surface B, a left surface L, a right surface R, a top surface U and a bottom surface D, wherein, an entrance 21 of the cashbox is set on the top surface U, for receiving the money.

The specific structure of the cashbox provided by the invention is described below. As shown in FIG. 2 and FIG. 3, the cashbox includes a main body assembly 4, a box door assembly 5 and an upper cover 6.

Figure 4:
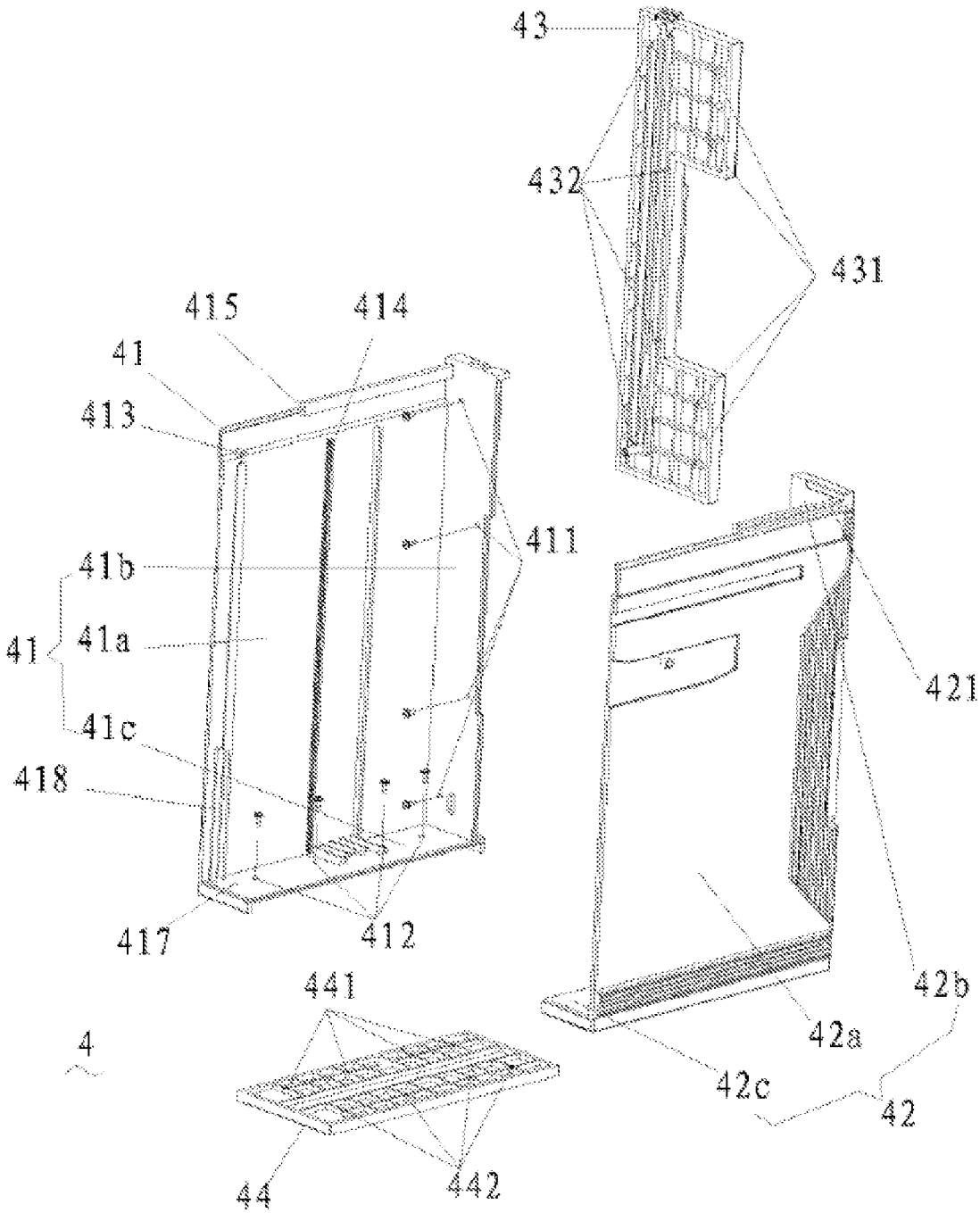
FIG. 4 shows a structural decomposition diagram of the main body assembly of the cashbox shown in FIG. 1.

FIG. 4 shows a structural decomposition diagram of the main body assembly of the cashbox shown in FIG. 1. As shown in FIG. 4, the main body assembly 4 includes a left shell 41 and a right shell 42 which are set symmetrically, and a first fixing panel 43 and a second fixing panel 44 which are set outside the left shell 41 and the right shell 42 respectively, for fixedly connecting the left shell 41 and the right shell 42.

Wherein, the left shell 41 includes three side walls vertical to each other, which are respectively the first side wall 41*a*, the second side wall 41*b* and the third side wall 41*c*; the right shell 42 and the left shell 41 are set symmetrically, and the right shell 42 similarly includes three side walls vertical to each other, which are respectively the fourth side wall 42*a*, the fifth side wall 42*b* and the sixth side wall 42*c*, wherein, the first side wall 41*a* and the fourth side wall 42*a* are set in parallel and spaced with a predetermined distance; the first side wall 41*a* is formed as the left surface L of the cashbox, and the fourth side wall 42*a* is formed as the right surface R of the cashbox.

The second side wall 41*b* of the left shell 41 is abutted with the fifth side wall 42*b* of the right shell 42, and the edges thereof are preferably joined together, and certainly, also can be spaced with a predetermined distance. The first fixing panel 43 is located inside or outside the left shell 41 and the right shell 42; the first fixing panel 43 is fixedly connected to the second side wall 41*b* of the left shell 41 and the fifth side wall 42*b* of the right shell 42 by using screws from the inside of the shell, thus, the first fixing panel 43, the second side wall 41*b* of the left shell 41 and the fifth side wall 42*b* of the right shell 42 are combined to form the front surface F of the cashbox 2.

The third side wall 41*c* of the left shell 41 is abutted with the sixth side wall 42*c* of the right shell 42, and the edges thereof are preferably joined together, and certainly also can be spaced with a predetermined distance. The second fixing panel 44 is located outside or inside the left shell 41 and the right shell 42; the first fixing panel 43 is fixedly connected to the third side wall 41*c* of the left shell 41 and the sixth side wall 42*c* of the right shell 42 by using screws from the inside of the shell, thus, the second fixing panel 44, the third side wall 41*c* of the left shell 41 and the sixth side wall 42*c* of the right shell 42 are combined to form the bottom surface D of the cashbox 2, so, the main body assembly 4 forms four sides, namely, the left surface L, the right surface R, the front surface F and the bottom surface D of the cashbox.

Figure 5:
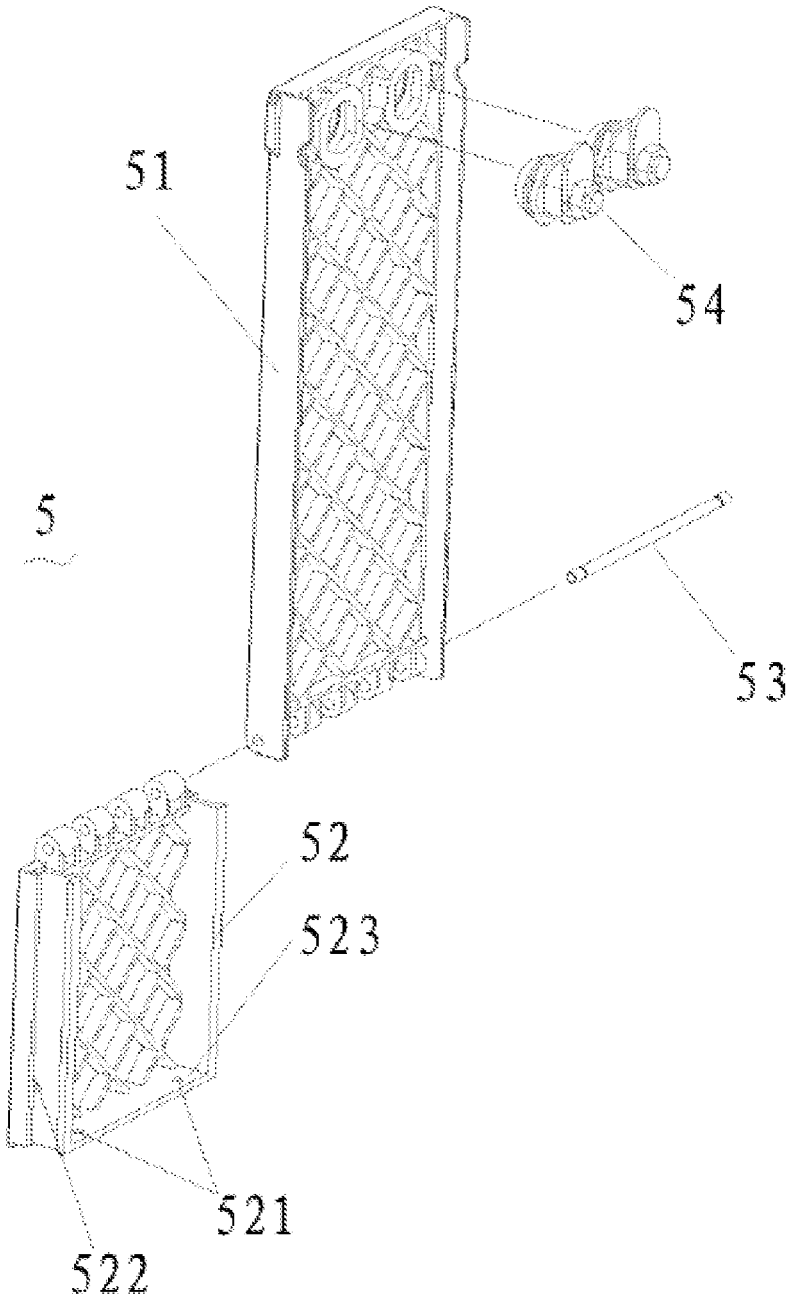
FIG. 5 shows a structural decomposition diagram of the box door assembly of the cashbox shown in FIG. 1.

FIG. 5 shows a structural decomposition diagram of the box door assembly of the cashbox shown in FIG. 1. As shown in FIG. 5, the box door assembly 5 includes a box door 51, a box door fixing panel 52, a pivot shaft 53 and a security lock 54, wherein, the box door 51 is hinged with the box door fixing panel 52 via the pivot shaft 53, and can be rotated around the pivot shaft 53; the security lock 54 is fixed on the box door 51, and can be matched with or separated from the upper cover 6 of the cashbox.

Two sides of the box door fixing panel 52 close to the left shell 41 and the right shell 42 are respectively provided with a first inserting slot 522, for respectively inserting with a first inserting plates 418 on the left shell 41 and the right shell 42; meanwhile, a plurality of fixing holes 521 are formed on one side of the box door fixing panel 52 close to the bottom surface D, namely, on the bottom wall 523 which is in overlapping extension with the left shell 41 and the right shell 42; the box door fixing panel 52 is fixedly connected to the third side wall 41*c* of the left shell 41 and the sixth side wall 42*c* of the right shell 42 of the main body assembly 4 by using screws via the fixing holes 521 inside the shell, such that the box door fixing panel 52 is fixedly connected with the main body assembly 4.

After the box door fixing panel 52 is fixedly connected with the main body assembly 4, the box door 51 and the box door fixing panel 52 form the back surface B of the cashbox together; the cashbox is closed or opened by controlling the security lock 54 and the upper cover 6 of the cashbox to be joined or separated, thus making the box door 51 and the upper cover 6 be connected or separated.

Figure 6:
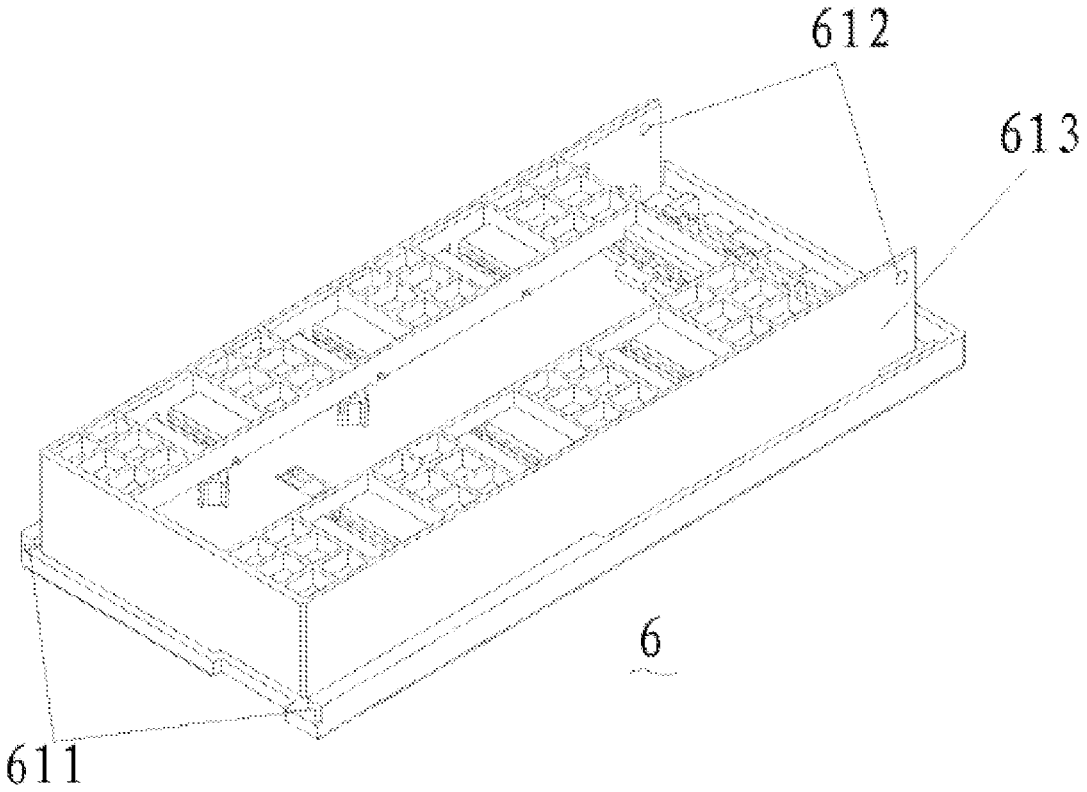
FIG. 6 shows an axonometric drawing of an upper cover of the cashbox shown in FIG. 1.

FIG. 6 shows an axonometric drawing of an upper cover of the cashbox shown in FIG. 1. As shown in FIG. 6, the upper cover 6 is a rectangular plate-type structure, of which the upper surface forms the top surface U of the cashbox 2; the entrance 21 is set on the upper surface for receiving money. The second inserting slots 611 are arranged on both sides of the upper cover 6 along the length direction of the upper cover 6, for respectively inserting with the second inserting plates 415 on the left shell 41 and the third inserting plate 421 on the right shell 42; two sixth through holes 612 are also provided on the side wall 613 of the upper cover 6 which is in overlapping extension with the left shell and the right shell, for fixedly connecting with the left shell 41 and the right shell 42 respectively.

When assembling the cashbox, the main body assembly 4 is firstly assembled, and then the box door fixing panel 52 of the box door assembly 5 is fixedly connected to the main body assembly 4, and finally the upper cover 6 is fixedly connected to the main body assembly 4. The specific process is as follows:

The first step: assembly of the main body assembly 4

Firstly, the left shell 41 and the right shell 42 are abutted, and then, the screws sequentially pass through the first through hole 411 on the second side wall 41*b* of the left shell 41 and the first fixing hole 432 on the first fixing panel 43 from the inside of the shell, so as to make the second side wall 41*b* of the left shell 41 be fixedly connected with the first fixing panel 43; and the screws sequentially pass through the second through hole (not drawn in the figure) on the fifth side wall 42*b* of the right shell 42 and the second fixing hole 431 on the first fixing panel 43 from the inside of the shell, so as to make the fifth side wall 42*b* of the right shell 42 be fixedly connected with the first fixing panel 43.

And then, the screws sequentially pass through the third through hole 412 on the third side wall 41*c* of the left shell 41 and the third fixing hole 441 on the second fixing panel 44 from the inside of the shell, so as to make the third side wall 41*c* of the left shell 41 be fixedly connected with the second fixing panel 44; the screws sequentially pass through the fourth through hole (not drawn in the figure) on the sixth side wall 42*c* of the right shell 42 and the fourth fixing hole 442 on the second fixing panel 44 from the inside of the shell, so as to make the sixth side wall 42*c* of the right shell 42 be fixedly connected with the second fixing panel 44.

Thus, the left shell 41 and the right shell 42 can be fixedly connected via the first fixing panel 43 and the second fixing panel 44.

The second step: installation of the box door assembly 5

The first inserting slots 522 on the box door fixing panel 52 are respectively inserted with the first inserting plates 418 on the left shell 41 and the right shell 42, then the screws respectively sequentially pass through the fixing hole 512 on the box door fixing panel 52 and the seventh fixing hole 417 on the left shell 41, and the fixing hole 512 on the box door fixing panel 52 and the eighth fixing hole (not drawn in the figure) on the right shell 42 from the inside of the shell, so as to make the box door fixing panel 52 be respectively fixedly connected with the left shell 41 and the right shell 42.

As the box door 51 is hinged with the box door fixing panel 52 via the pivot shaft 53, the box door 51 and the box door fixing panel 52 can be folded by rotating the box door 51 towards the direction far from the front surface F of the cashbox, and now, no matter how deep the box body of the cashbox is, the screws can be installed inside the shell by using the standard installation tools (such as the standard screwdriver).

The third step: installation of the upper cover 6

Firstly, by rotating the box door 51 towards the direction far from the front surface F of the cashbox, and then making the second inserting slots 611 on the upper cover 6 to respectively insert with the second inserting plates 415 on the left shell 41 and the third inserting plate 421 on the right shell 42, and then, using the screws to sequentially pass through the sixth through hole 612 on the upper cover 6 and the ninth fixing hole 413 on the left shell 41 from the inside of the shell, the upper cover 6 and the left shell 41 can be fixedly connected; by using the screws to sequentially pass through the sixth through hole 612 on the upper cover 6 and the tenth fixing hole (not drawn in the figure) on the right shell 42 from the inside of the shell, the upper cover 6 and the right shell 42 can be fixedly connected.

It should note that, the sixth through holes 612 on the upper cover 6 are preferably located on one side of the upper cover 6 close to the box door assembly 5, thus, no matter how long the length of the upper cover of the cashbox is, in the case that the box door is open, the standard installation tools (such as the standard screwdrivers) can enter the shell from the opening of the cashbox to install the screws, so as to make the upper cover 6, the left shell 41 and the right shell 42 be fixedly connected.

After the cashbox is completely assembled, the spring bolt of the security lock 54 is rotated by a key, so as to be inserted with or separated from the baffle plate (not shown in the figure) installed on the upper cover 6, thus, the box door 51 and the upper cover 6 are connected or separated, to make the cashbox be closed or opened. As the structure and setting mode of the security lock are known by those skilled in the art, and the setting has little relevance to the invention, they are not repeated here.

For the cashbox provided by the invention, all components of the cashbox are fixedly connected by the screws from the inside of the cashbox shell, and no exposed screw is installed outside the cashbox, the possibility of disassembling the cashbox during the replacement and transportation process of the cashbox can be prevented, and the security of the equipment can be improved.

Figure 7:
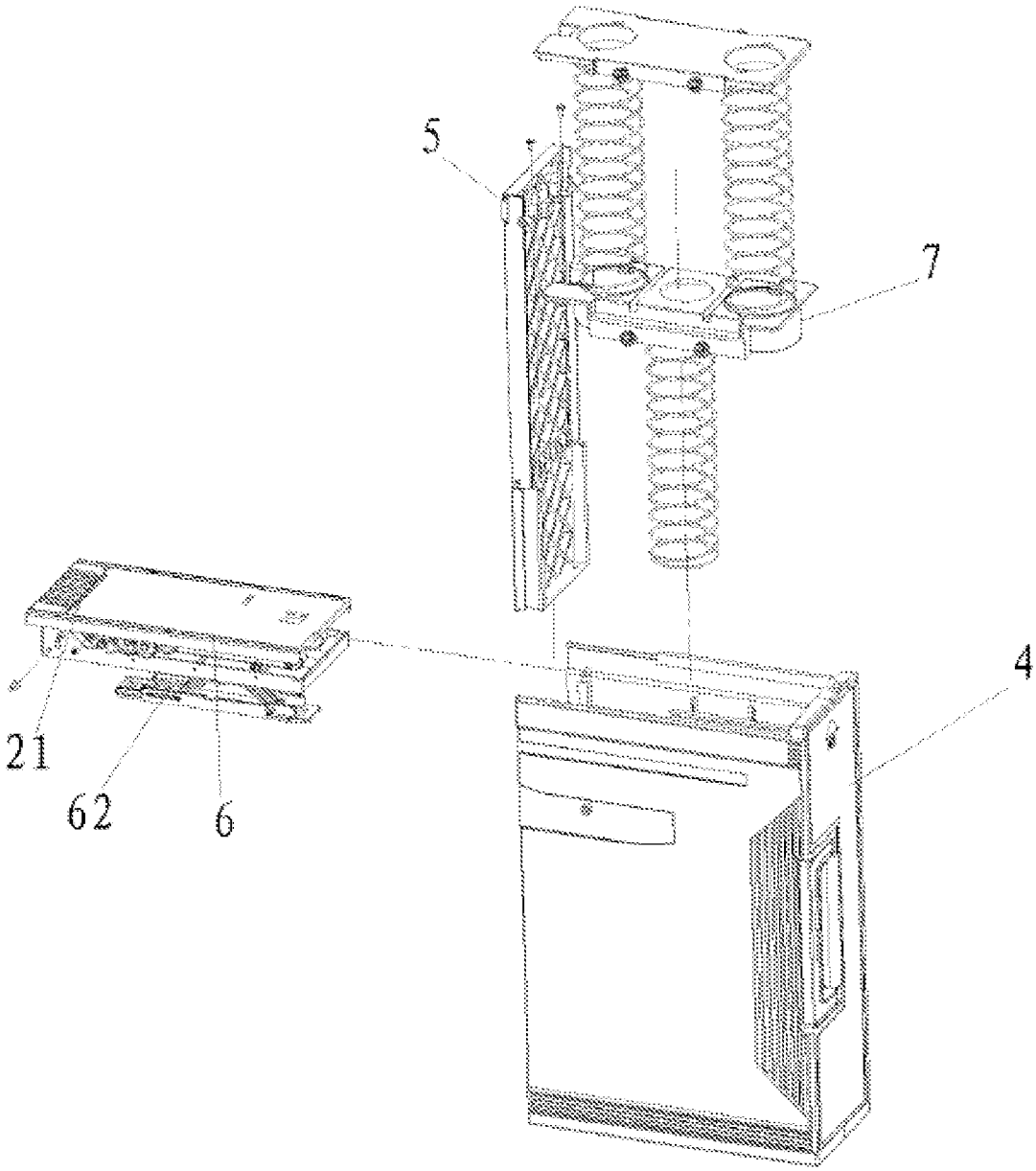
FIG. 7 shows a structural decomposition diagram of the second embodiment according to the cashbox provided by the invention.

FIG. 7 shows a structural decomposition diagram of the second embodiment according to the cashbox provided by the invention; the cashbox in this embodiment is used for storing paper money; compared with the former embodiment, the difference is that, the cashbox in this embodiment further includes a money pressing assembly 62 and a paper money supporting plate assembly 7, wherein, the money pressing assembly 62 is fixedly installed on the lower surface of the upper cover 6, for receiving the paper money entering from the entrance 21, and pressing the paper money inside the cashbox; the paper money supporting plate assembly 7 is located inside the cashbox, and is connected with the bottom surface D of the cashbox, for supporting the paper money pressed by the money pressing assembly 62.

Figure 8:
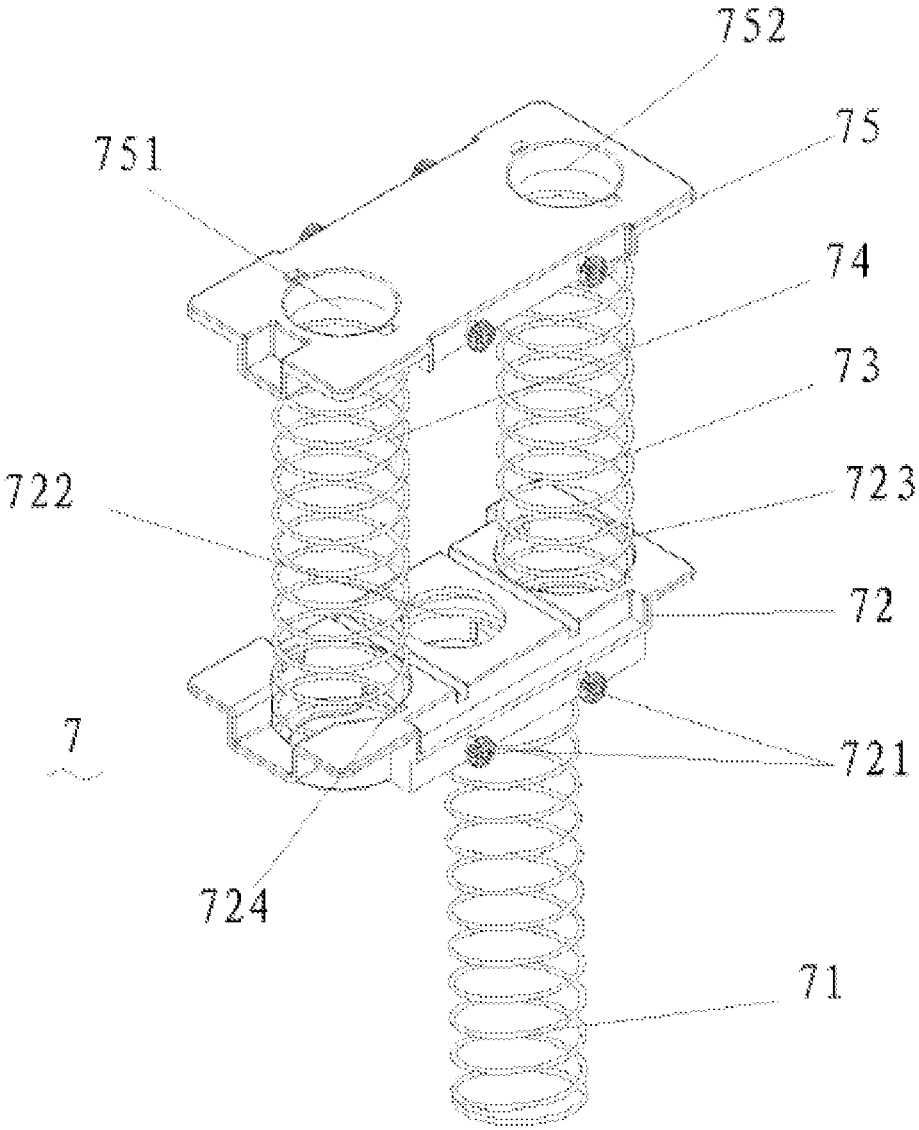
FIG. 8 shows an axonometric drawing of the paper money supporting plate assembly of the cashbox shown in FIG. 7.

FIG. 8 shows an axonometric drawing of the paper money supporting plate assembly of the cashbox shown in FIG. 7. As shown in FIG. 7, the paper money supporting plate assembly 7 includes a first elastic element 71, a bracket plate 72, a second elastic element 73, a third elastic element 74 and a supporting plate 75.

Wherein, the first elastic element 71 is placed inside the cashbox along the paper money stacking direction; one end of the first elastic element 71 is fixedly connected with the bottom surface D of the cashbox; the bracket plate 72 is placed vertically to the paper money stacking direction, and a first installation hole 722 is set in the center of the bracket plate 72, for fixedly connecting with the other end of the first elastic element 71; a second installation hole 723 and a third installation hole 724 which are symmetric to the first installation hole 722 are set on the upper surface of the bracket plate 72.

The first guiding elements 721 are symmetrically installed on both sides of the long side and/or short side of the bracket plate 72; the first guiding elements 721 can be the parts such as bearings, rollers and gears; the first guiding elements 721 are installed in pairs and spaced with a predetermined distance, and are respectively matched with the second guide rails 414 (shown in FIG. 4) installed on the left shell 41 and the right shell 42, such that the bracket plate 72 can move back and forth towards the paper money stacking direction along the second guide rails 414; due to the limiting effect of the second guide rails 414, the shaking of the bracket plate 72 caused during the movement process can be prevented.

It should note that, when the first guiding elements 721 are gears, the second guide rails 414 installed on the left shell 41 and the right shell 42 are rackes which extend along the paper money stacking direction; the gear and the rack are engaged to transmit, so as to make the bracket plate 72 which is fixedly connected with the gear move along the length direction of the rack. When the first guiding elements 721 are bearings, the second guide rails 414 installed on the left shell 41 and the right shell 42 are long grooves which extend along the paper money stacking direction; the bearing roll in the long groove, such that the bracket plate 72 can move along the length direction of the long groove.

The supporting plate 75 is provided with a fourth installation hole 751 and a fifth installation hole 752, both the second elastic element 73 and the third elastic element 74 are placed along the paper money stacking direction; one end of each of the second elastic element 73 and the third elastic element 74 is respectively fixedly connected with the second installation hole 723 and the third installation hole 724 on the bracket plate 72, and the other end thereof is respectively connected with the fourth installation hole 751 and the fifth installation hole 752 on the supporting plate 75.

Because of the elastic effect of the first elastic element 71, the second elastic element 73 and the third elastic element 74, the supporting plate 75 is always tightly contacted with the lower surface of the money pressing assembly 62; when the paper money enters the money pressing assembly 62 from the entrance 21, the money pressing assembly 62 regularly presses the paper money on the upper surface of the supporting plate 75, then the paper money enters the cashbox.

It should note that, in another embodiment of the invention, the first elastic element 71 and the bracket plate 72 are omitted, and one end of each of the second elastic element 73 and the third elastic element 74 is directly fixed on the bottom surface D of the cashbox, and the other end thereof is connected with the supporting plate 75, and the first guiding element 721 is installed on the supporting plate 75; in another embodiment of the invention, the second elastic element 73, the third elastic element 74 and the bracket plate 72 are omitted, and one end of the first elastic element 71 is fixedly connected with the bottom surface D of the cashbox, and the other end thereof is connected with the supporting plate 75.

Figure 9:
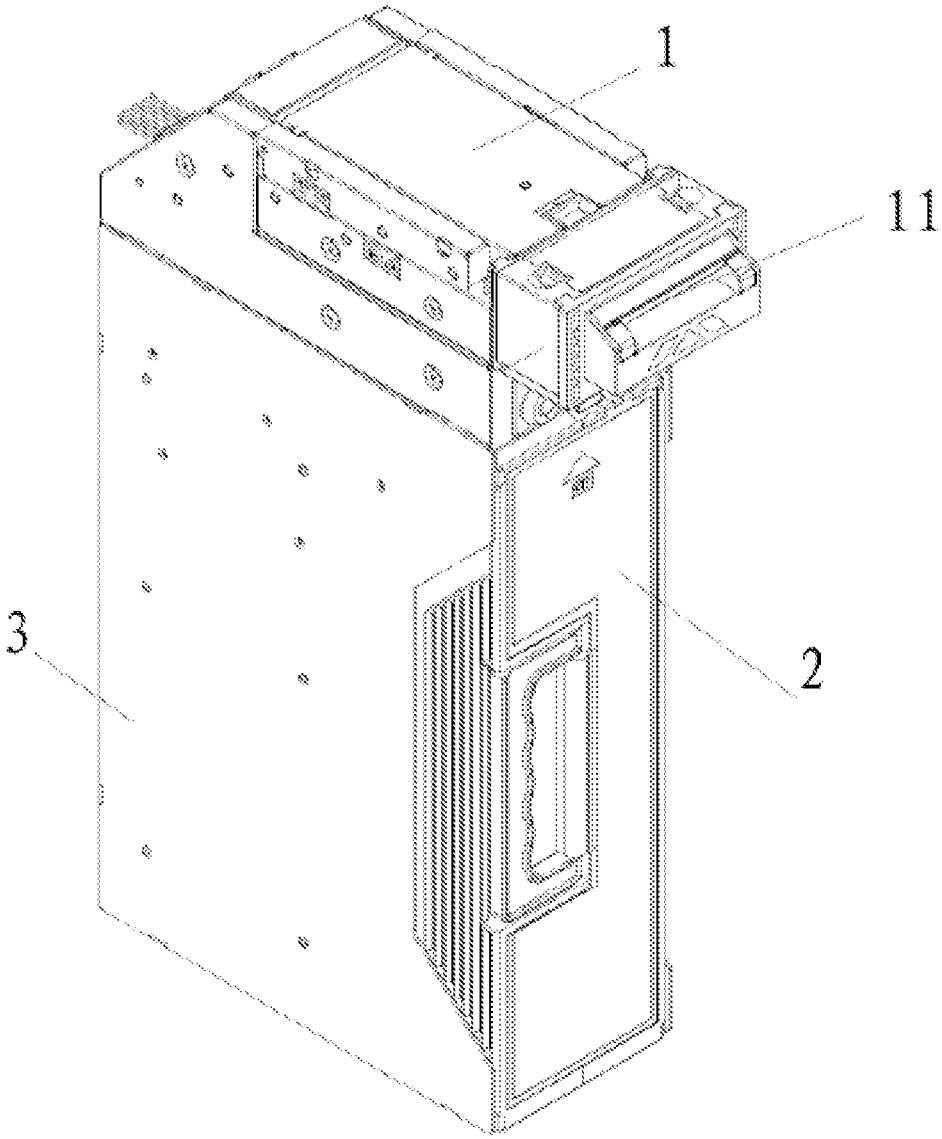
FIG. 9 shows a structural diagram of a money validator with the cashbox according to the invention.
Figure 10:
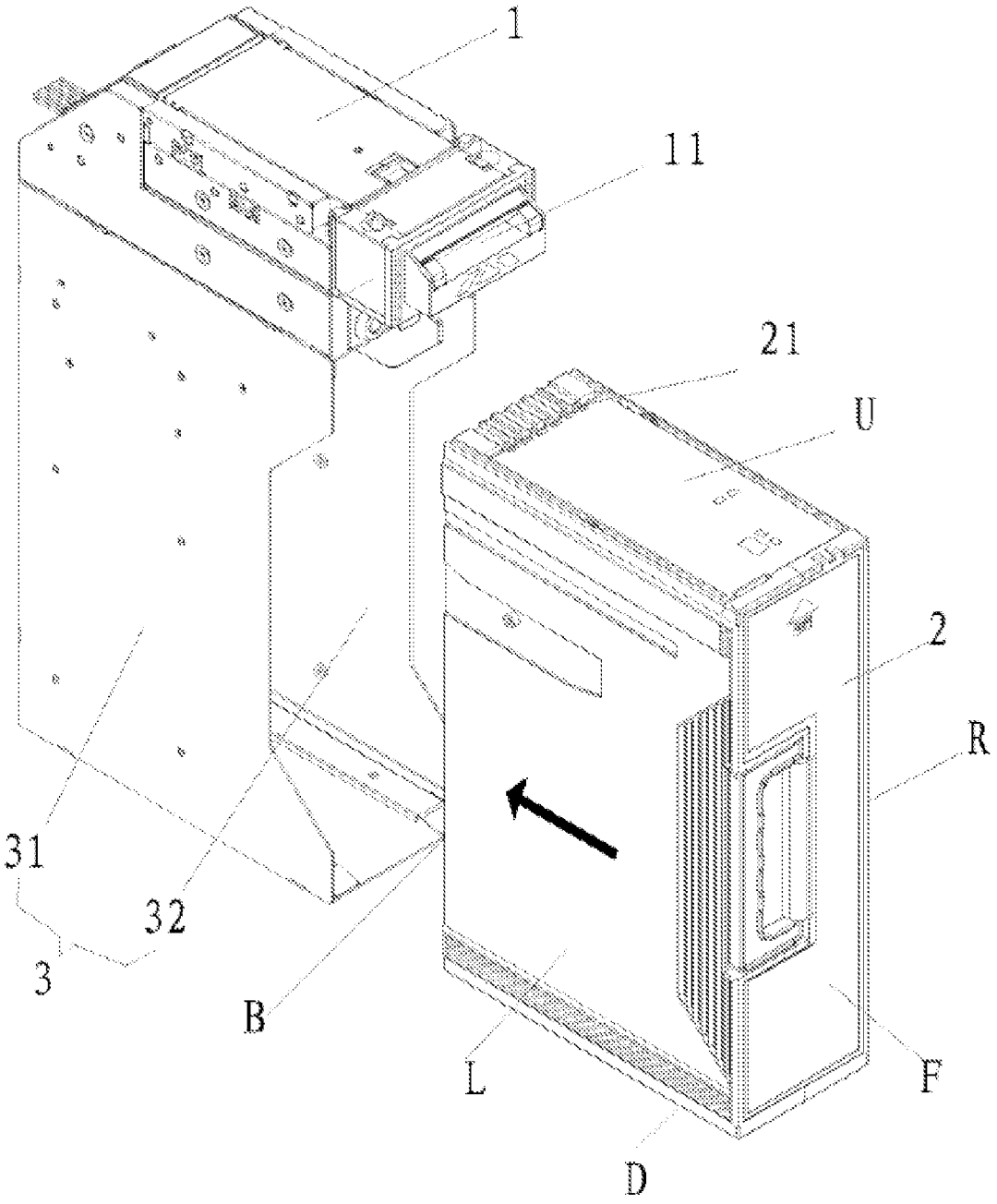
FIG. 10 shows a structural diagram of assembling the cashbox shown in FIG. 9 to the money validator.

FIG. 9 shows a structural diagram of a money validator with the cashbox according to the invention; FIG. 10 shows a structural diagram of assembling the cashbox shown in FIG. 9 to the money validator.

As shown in FIG. 9 and FIG. 10, the money validator includes a money identification mechanism 1, a cashbox 2 and a bracket 3, wherein the bracket 3 includes a left side wall 31, a right side wall 32 and a top plate (not shown in the figure); the left side wall 31 and the right side wall 32 are set in parallel relatively, the top plate is vertically supported between the left side wall 31 and the right side wall 32; the money identification mechanism 1 is fixedly installed on the top plate for identifying the true money and counterfeit money; the specific implementation mode of the cashbox 2 is the same as the above embodiments, and is not repeated.

The cashbox 2 is fixedly installed between the left side wall 31 and the right side wall 32 of the bracket 3; the entrance 21 on the cashbox 2 is communicated with the exit (not shown in the figure) of the money identification mechanism 1, for receiving the valid money which is identified, and storing the money inside the cashbox.

The paper money enters the money identification mechanism 1 from the entrance 11 of the money identification mechanism 1; the money identification mechanism 1 identifies the information of the paper money, and judges whether the paper money is true; if judging that the paper money is true, the money identification mechanism 1 conveys the paper money to the cashbox 2, and the paper money is stored inside the cashbox from the entrance 21 of the cashbox 2; if judging that the paper money is counterfeit, the money identification mechanism 1 exits the counterfeit money from the entrance 11; after the cashbox 2 is filled, or after completing the pre-set time, the cashbox 2 is disassembled, and a new empty cashbox is replaced; the disassembled cashbox is conveyed to the settlement center to be unlocked by the specially-assigned person, so as to collect and aggregate the paper money.

As all the components of the cashbox which is used by the money validator in this embodiment are fixedly connected by using the screws from the inside of the cashbox, and no exposed screw is installed outside the cashbox, the possibility of detaching the cashbox during the replacement and transportation process of the cashbox can be prevented, and the security of the money validator can be improved.

The above are only the preferred embodiments of the invention and not intended to limit the invention, and for those skilled in the art, the invention can have various modifications and changes. Any modifications, equivalent replacements, improvements and the like within the spirit and principle of the invention shall fall within the scope of protection of the invention.

| Description of reference marks | |
|---|---|
| 1: money identification mechanism | 2: cashbox |
| 21: entrance of cashbox | 3: bracket |
| 31: left side wall | 32: right side wall |
| 4: main body assembly | 41: left shell |
| 42: right shell | 43: the first fixing panel |
| 44: the second fixing panel | 418: the first inserting plate |
| 415: the second inserting plate | 421: the third inserting plate |
| 417: the seventh fixing hole | 413: the ninth fixing hole |
| 414: the second guide rail | 5: box door assembly |
| 51: box door | 52: box door fixing panel |
| 53: pivot shaft | 54: security lock |
| 521: fixing hole (the fifth through hole) | 522: the first inserting slot |
| 523: bottom wall | 6: upper cover |
| 62: money pressing assembly | 611: the second inserting slot |
| 612: the sixth through hole | 613: side wall |
| 41a: the first side wall | 41b: the second side wall |
| 41c: the third side wall | 42a: the fourth side wall |
| 42b: the fifth side wall | 42c: the sixth side wall |
| 7: paper money supporting plate assembly | 71: the first elastic element |
| 72: bracket plate | 73: the second elastic element |
| 74: the third elastic element | 75: supporting plate |
| 722: the first installation hole | 723: the second installation hole |
| 724: the third installation hole | 721: the first guiding element |
| 751: the fourth installation hole | 752: the fifth installation hole |

The invention claimed is:

1. A cashbox comprising a front surface, a back surface, a left surface, a right surface, a bottom surface, and a top surface, wherein the cashbox comprises:

a left shell comprising a first side wall forming the left surface, a second side wall at least partially forming the front surface, and a third side wall at least partially forming the bottom surface;

a right shell comprising a fourth side wall forming the right surface, a fifth side wall at least partially forming the front surface, and a sixth side wall at least partially forming the bottom surface;

a first fixing panel fixedly connected through screws to the second side wall and the fifth side wall which are located at an inner side of the first fixing panel, so as to form the front surface together with the second side wall and the fifth side wall;

a second fixing panel fixedly connected through screws to the third side wall and the sixth side wall which are located at an inner side of the second fixing panel, so as to form the bottom surface together with the third side wall and the sixth side wall;

an upper cover with a money entrance forming the top surface, and being inserted to and between the left shell and the right shell; and a box door fixing panel and a box door which is pivotally connected to the box door fixing panel through a pivot shaft, the box door fixing panel and the box door forming the back surface of the cashbox together, wherein the box door fixing panel is inserted to and between the left shell and the right shell, and the box door is connected with the upper cover through a security lock.

2. The cashbox according to claim 1, wherein an edge of the third side wall and an edge of the sixth side wall are connected together.

3. The cashbox according to claim 1, wherein an edge of the second side wall and an edge of the fifth side wall are connected together.

4. The cashbox according to claim 1, wherein the upper cover is further fixedly connected with the left shell and the right shell through screws, and fixing holes for the screws are located on side walls of the upper cover, which are respectively in overlapping arrangement with the left shell and the right shell, and are located in a position away from the front surface.

5. The cashbox according to claim 1, wherein the box door fixing panel is further fixedly connected with the left shell and the right shell through screws, and fixing holes for the screws are located on a bottom wall of the box door fixing panel, which is in overlapping arrangement with the left shell and the right shell.

6. The cashbox according to claim 1, further comprising a money pressing assembly located on a lower surface of the upper cover, and a paper money supporting plate assembly located in the cashbox, wherein the paper money supporting plate assembly comprises a supporting plate cooperating with the money pressing assembly and an elastic element which elastically supports the supporting plate.

7. The cashbox according to claim 6, wherein a guiding element is provided on the supporting plate, and a guide rail cooperating with the guiding element is provided on the left shell and the right shell.

8. The cashbox according to claim 7, wherein the guiding element is a gear, and the guide rail is a rack.

9. The cashbox according to claim 6, wherein the elastic element comprises a second elastic element and a third elastic element; the paper money supporting plate assembly further comprises a bracket plate which supports the second elastic element and the third elastic element and a first elastic element which supports the bracket plate.

10. A money validator comprising the cashbox according to claim 1, a money identification mechanism, and a bracket which supports the cashbox and the money identification mechanism, wherein the money entrance of the cashbox is communicated with a money exit of the money identification mechanism.

11. A cashbox comprising a front surface, a back surface, a left surface, a right surface, a bottom surface and a top surface, wherein the cashbox comprises:

a left shell comprising a first side wall forming the left surface, a second side wall at least partially forming the front surface, and a third side wall at least partially forming the bottom surface;

a right shell comprising a fourth side wall forming the right surface, a fifth side wall at least partially forming the front surface, and a sixth side wall at least partially forming the bottom surface;

a first fixing panel fixedly connected through screws to the second side wall and the fifth side wall to form the front surface together with the second side wall and the fifth side wall;

a second fixing panel fixedly connected through screws to the third side wall and the sixth side wall to form the bottom surface together with the third side wall and the sixth side wall;

an upper cover with a money entrance forming the top surface, and inserted to and between the left shell and the right shell; and a box door fixing panel and a box door which is pivotally connected to the box door fixing panel through a pivot shaft, forming the back surface of the cashbox together, wherein the box door fixing panel is inserted to and between the left shell and the right shell, and the box door is connected with the upper cover through a security lock.

12. The cashbox according to claim 11, wherein an edge of the third side wall and an edge of the sixth side wall are connected together.

13. The cashbox according to claim 11, wherein an edge of the second side wall and an edge of the fifth side wall are connected together.

14. The cashbox according to claim 11, further comprising a money pressing assembly located on a lower surface of the upper cover, and a paper money supporting plate assembly located in the cashbox, wherein the paper money supporting plate assembly comprises a supporting plate cooperating with the money pressing assembly and an elastic element which elastically supports the supporting plate.

* * * * *